US005167793A

United States Patent [19]

Jozefowicz

[11] Patent Number: 5,167,793

[45] Date of Patent: Dec. 1, 1992

[54] PROCESS FOR PRODUCING ANODIC FILMS EXHIBITING COLORED PATTERNS AND STRUCTURES INCORPORATING SUCH FILMS

[75] Inventor: Mark A. Jozefowicz, Kingston, Ontario, Canada

[73] Assignee: Alcan International Limited, Montreal, Quebec, Canada

[21] Appl. No.: 696,840

[22] Filed: May 7, 1991

[51] Int. Cl.[5] ..... C25D 11/18

[52] U.S. Cl. ..... 205/121; 205/229

[58] Field of Search ..... 205/121, 229

[56] References Cited

U.S. PATENT DOCUMENTS

| | | | |
|---|---|---|---|
| 4,066,516 | 1/1978 | Sato | 204/15 |
| 4,066,816 | 1/1978 | Sheasby et al. | 428/336 |
| 4,310,586 | 1/1982 | Sheasby et al. | 428/220 |
| 4,921,823 | 5/1990 | Furneaux et al. | 502/4 |

FOREIGN PATENT DOCUMENTS

| | | |
|---|---|---|
| 49-27449 | 3/1974 | Japan . |
| 59-5678 | 9/1982 | Japan . |

*Primary Examiner*—T. M. Tufariello

*Attorney, Agent, or Firm*—Cooper & Dunham

[57] ABSTRACT

A process for producing a structure including an anodic film exhibiting a colored pattern, and the resulting structures. The process involves anodizing a surface of a metal substrate or article made of or coated with aluminum or an anodizable aluminum alloy to produce an anodic film preferably having pores extending from the film surface inwardly towards the underlying metal. A semi-refective layer of a non-noble metal is then deposited on or within the pores of the film in order to generate a color by effects including light interference. Limited areas of the resulting film are then contacted with a solution of a noble metal compound (e.g. Pd, Au or Pt) by a procedure which avoids the use of an adhering mask. The noble metal from the solution at least partially replaces the non-noble metal in the contacted areas and creates a different color in these areas. The non-noble metal in the remaining areas may be fully or partially leached out, if desired, or the color in the contacted areas may be changed by carrying out further anodization of the article, in which case the non-noble metal is also partially or fully leached away. The result is patterned anodized article in which the colors are highly resistant to fading or lack of uniformity.

16 Claims, 3 Drawing Sheets

PROCESS FOR PRODUCING ANODIC FILMS EXHIBITING COLORED PATTERNS AND STRUCTURES INCORPORATING SUCH FILMS

BACKGROUND OF THE INVENTION

I. Field of the Invention

This invention relates to the formation of anodic films having areas of discernably different colours, shades, hues or colour densities forming patterns, printing or other indicia (referred to hereinafter generally as coloured patterns) and to structures incorporating such films.

II. Description of the Prior Art

Anodizing is a well known surface treatment carried out on articles made of (or coated with) aluminum or anodizable aluminum alloys for the purpose of improving the decorative appeal of the articles and/or for improving surface durability. The procedure involves electrolysis carried out in an electrolyte containing a strong acid, such as sulphuric acid, phosphoric acid, oxalic acid or the like, using the aluminum article as an anode. As the electrolysis proceeds, an anodic film of aluminum oxide grows on the metal surface, with the thickness of the film increasing as the electrolysis continues. Competition between the growth of the anodic film and dissolution of the oxide by the acidic electrolyte creates a film having pores which extend from the external film surface inwardly towards the metal article. However, the innermost ends of the pores are always separated from the metal surface by a very thin barrier layer of dense imperforate anodic oxide. If a non-porous anodic film is desired, the anodization can be carried out in a less acidic electrolyte, but only very thin films can be produced in this way depending on the voltage used for the anodization procedure, so the formation of porous films is more usual.

Articles anodized in this way have surfaces which range from grey (i.e. the colour of the underlying metal, generally referred to hereinafter as "colourless" or "clear") to white in appearance depending on the thickness of the oxide film, but various procedures have been developed to colour the anodic films in order to improve the appeal of the articles to the eye. These range from the so-called ANOLOK (trade mark of ALCAN ALUMINUM LTD) processes, which involve the electrolytic deposition of a metal (inorganic pigment) into the pores, to the use of dies or organic pigments to cause staining of the anodic film.

While these colouring procedures have been applied successfully for many purposes, they suffer from certain disadvantages. For example, articles coloured by the ANOLOK procedures (as disclosed in our prior U.S. Pat. Nos. 4,066,816 of Jan. 3, 1978 and 4,310,586 of Jan. 12, 1982, both to Sheasby et. al.) may exhibit lack of colour uniformity and the procedure may be difficult to control. Articles coloured by organic pigments and the like exhibit fading when exposed to UV light, and have therefore not been used extensively in exterior (e.g. architectural or automotive) applications.

Moreover, when it is desired to produce coloured patterns on the surfaces of anodized articles, resort has generally been made to the use of adhering masks and the like to cover certain areas of the surface while other areas are subjected to a colouring treatment. The masks then have to be removed and, if desired, further areas masked so that the uncoloured areas can themselves be coloured. This is not only a complex and expensive procedure, it also requires the use of masking materials and solvents that may cause environmental problems when disposed of.

In our prior U.S. patent application Ser. No. 07/497,222 filed on Mar. 22, 1990, a method is described of producing optical interference structures incorporating porous anodic films in which interference colours are generated by the inclusion of semi-refective layers into the films by electrodeposition and the like. It is disclosed that the deposits may be made more resistant to leaching by replacing the deposited metal with a noble metal which is much more corrosion resistant. However, the method is used only for producing films of uniform colour throughout, rather than patterned films. If patterns are required, masking techniques must again be employed.

OBJECTS OF THE INVENTION

It is therefore an object of the invention to provide a process which can result in the production of patterned anodic films which are less susceptible to colour loss (fading) or loss of colour uniformity, while providing a good range of colours.

It is also an object, at least of preferred forms of the invention, to provide a process which can produce coloured patterns on anodized surfaces without resort to the use of masks temporarily adhered to the anodized surfaces.

Yet another object of the invention is to provide a process for producing coloured patterns on an anodized surface by a procedure which generates colours at least partially by interference effects.

SUMMARY OF THE INVENTION

According to one aspect of the present invention there is provided a process for producing a structure incorporating an anodic film exhibiting a coloured pattern, which process comprises anodizing a surface of a substrate made of or coated with an anodizable metal selected from the group consisting of aluminum and anodizable aluminum alloys, to produce an anodic film preferably having pores therein formed on an underlying metal surface; depositing a semi-refective layer of a non-noble metal on or within said film such that reflections from said semi-refective layer contribute to the generation of a visible colour by effects including light interference; and contacting limited areas of said film with a solution of a noble metal compound by a maskless technique in order to at least partially replace said non-noble metal in said limited areas with said noble metal while leaving said non-noble metal in other areas of said film unaffected.

According to another aspect of the invention there is provided a structure incorporating a patterned anodic film, said structure comprising a metal substrate; an anodic film overlying said substrate; and a semi-refective layer on or within said film, in limited areas thereof, comprising deposits of a noble metal, said semi-refective layer contributing to the generation of a visible colour by effects including light interference; said film including areas other than said limited areas exhibiting a colour different from said colour of said limited areas.

According to yet another aspect of the invention, there is provided a thin flexible membrane having a coloured pattern, comprising a thin flexible metal substrate; an anodic film overlying said substrate, a semi-refective layer on or within said film, in limited areas thereof, comprising deposits of a noble metal, said semi-refective layer contributing to the generation of a colour by effects including light interference; said film including areas other than said limited areas exhibiting a colour different from said colour of said limited areas; and a layer of transparent flexible material overlying and supporting said anodic film.

It should be appreciated that, throughout this disclosure and the accompanying claims, when reference is made to different colours, it is intended that this expression should include any discernable differences whatsoever of the coloured areas, including differences of colour shade, hue or saturation of a single colour as well as distinctly different colours. It should also be appreciated that the term "pattern" or any derivative thereof is intended to include any abstract, irregular or regular pattern, printing, marking, indicia or any other shape or arrangement of areas of the anodic film having different appearance.

Furthermore, by the expression "maskless techniques" we mean techniques of applying the solution of the noble metal to the anodic film which avoid the prior application of adhering masks to the anodic film. Examples of such maskless techniques include flexographic printing of the noble metal solution onto the anodic film, rubber stamping, spraying coarse droplets, pulsed spraying to form random dot or streak patterns, application by pen, paint brush or sponge, spraying through a stencil, silk screening, etc.

BRIEF DESCRIPTION OF THE DRAWINGS

Like elements are identified by like reference numerals throughout the various figures.

It should be noted that the various elements of any particular figure are not drawn to scale.

DETAILED DESCRIPTION OF THE PREFERRED EMBODIMENTS

Figure 1A:
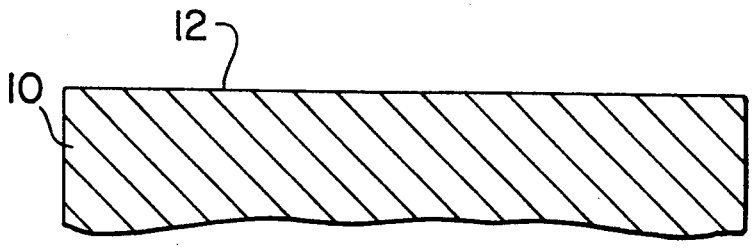
FIGS. 1(A) to (E) snow cross-sections or an aluminum article at the surface region thereof after various steps in a preferred basic process according to the present invention.

FIGS. 1(A)–1(E) show the steps of a basic preferred process according to the invention. FIG. 1(A) shows an article 10 made of, or coated with; aluminum or an anodizable aluminum alloy acting as a substrate for the formation of an anodic film and having an outer surface 12. The article may be, for example, a thin flexible foil, a laminate, a plate, a sheet, an extrusion, a casting, a shaped element or any other article of manufacture of the kind normally subjected to anodization either for decorative reasons (e.g. as a decorative article or packaging) or for protection (e.g. for use in architectural or automotive applications).

Figure 1B:
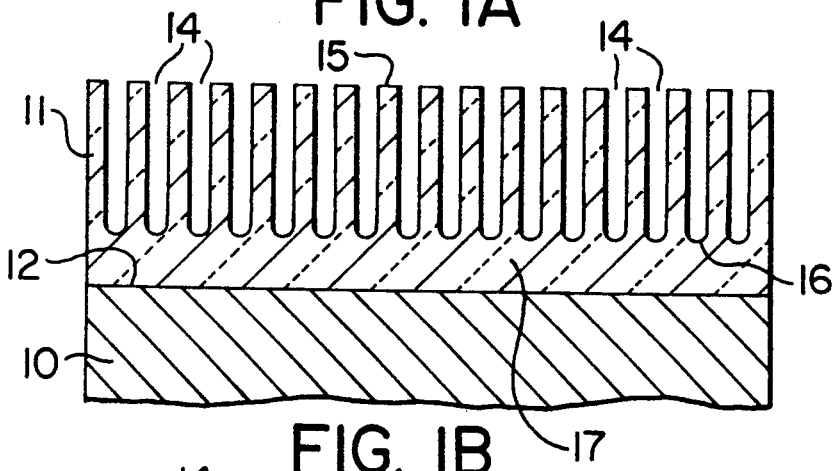

As shown in FIG. 1(B), in the basic procedure, the article 10 is first subjected to a porous anodization step to form an anodic film 11 on an underlying outer surface 12 of the article, the film having pores 14 extending inwardly from the outer surface 15 of the film towards the metal article 10.

The formation of the porous anodic film can be achieved in the conventional manner, e.g. by immersing the surface 12 in an electrolyte containing an inorganic acid, such as sulphuric acid, phosphoric acid or chromic acid, or an organic acid such as oxalic acid, or a mixtures of such acids, providing an electrode in contact with the electrolyte and applying a voltage between the electrode and the article. The voltage may be AC, DC, AC/DC, high voltage, low voltage, ramped voltage, etc. and is normally in the range of 5–110 V. However, the final stage of the anodization should be carried out in such a way that inner ends 16 of the pores 14 remain separated from the metal article 10 by a thin barrier layer 17 of imperforate anodic oxide of suitable thickness to permit subsequent electrolytic deposition of a metal in the pores 14. The barrier layer 17 should consequently have a thickness in the range of 20–500 Å, and more preferably 50–200 Å. This can be achieved by carrying out at least the last few seconds of the anodization under DC conditions with the article 10 forming the anode at a voltage of between 2–50 volts, preferably 5–20 volts.

While the pores 14 may be of uniform thickness throughout their length as shown in FIG. 1(B), it is more preferable to produce pores having narrow outer portions and wider inner portions (not shown). This results in metal deposits in the wider portions having larger outer surfaces, which in turn leads to stronger reflections from these surfaces and thus to enhanced interference effects and stronger generated colours. So-called "bottle neck" pores of this kind can be produced by changing the acid of the electrolyte part of the way through the electrolysis procedure from a less corrosive acid (e.g. sulphuric acid) to a more corrosive acid (e.g. phosphoric acid) (for more details of this procedure, see our U.S. Pat. No. 4,066,816 to Sheasby et al, the disclosure of which is incorporated herein by reference).

The film 11 can be made to have virtually any desired thickness by carrying out the electrolysis for a suitable length of time. For decorative interior applications, the film 11 may be just a few microns thick, but for architectural or automotive applications, the film may be up to 25 microns or more in thickness.

Figure 1C:
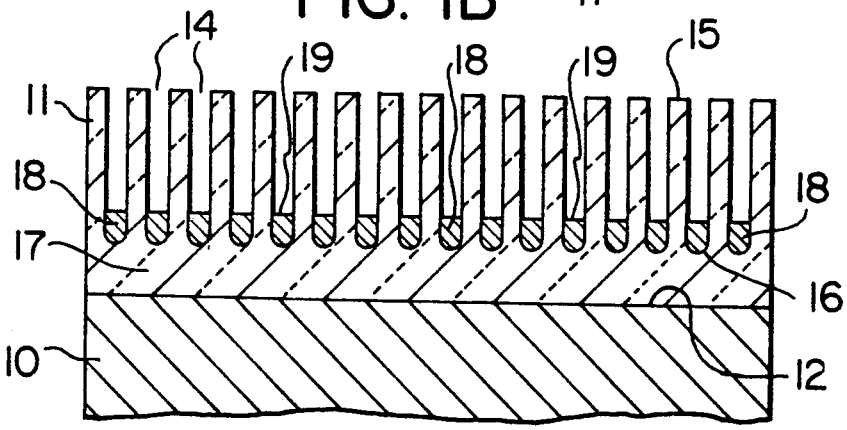
Figure 1D:
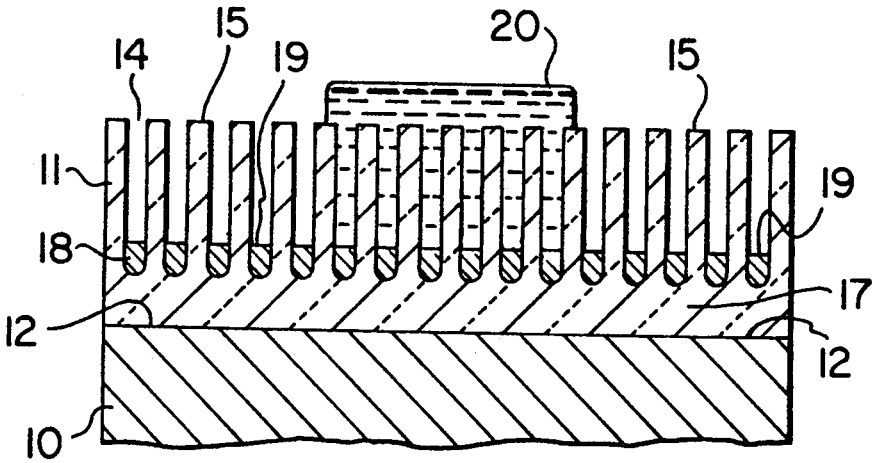

Metal deposits 18 as shown in FIG. 1(C) are then introduced into the pores 14 at their inner ends by an electrodeposition technique. This can be achieved, for instance, by the procedure described in our U.S. Pat. No. 4,066,816 mentioned above. For example, the anodized surface may be immersed in an acidic solution of an appropriate metal salt (e.g. a salt of nickel, cobalt, tin, copper, silver, alloys such as Sn-Ni and Cu-Ni, cadmium, iron, lead, manganese and molybdenum) as an electrolyte, a counter electrode (made for example of graphite or stainless steel, or nickel, tin or copper when the electrolyte contains a salt of the corresponding metal) provided in contact with the solution and an alternating voltage applied between the article and the counter electrode.

As will be seen from FIG. 1(C), the electrodeposition is not usually continued until the pores 14 are completely filled but rather until the outer ends 19 of the deposits 18 collectively form a semi-refective surface which is separated from the underlying metal surface 12 (the oxide/metal interface) by a distance in the order of 500–3000 Å (0.05–0.3 microns). Optical interference can then take place between light reflected from the surfaces 19 of the deposits 18 and the surface 12 of the underlying metal. This results in the production of an interference colour whose appearance depends largely on the difference in optical path of the light reflected from the two surfaces but also partly on the light absorption properties of the deposits 18. Since the present invention relies on the generation of colour to a large extent by interference effects, only small amounts of the metal need be deposited, so short term and/or low voltage deposition is generally used. The result is a range of attractive colours, including blue-grey, yellow-green, orange and purple, depending on the identity of the electrodeposited metal and the height of the deposits.

Figure 1E:
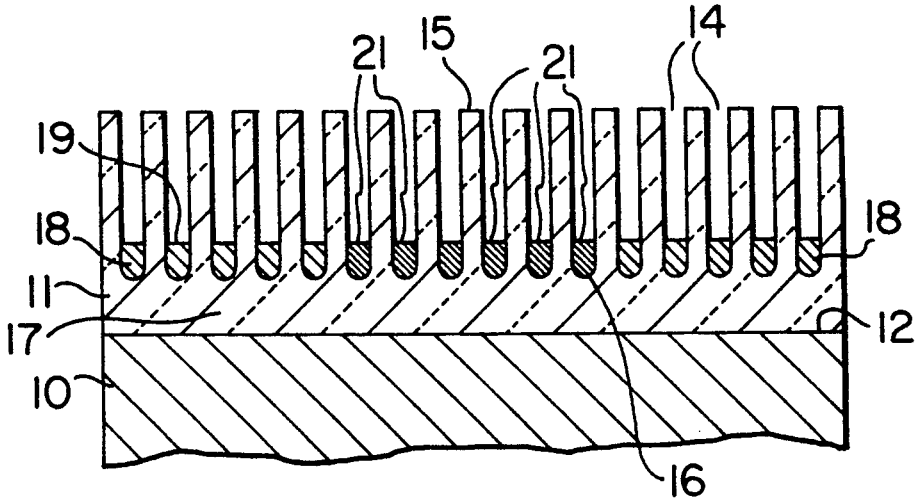

Following the introduction of deposits 18 into the pores, limited areas of the surface 15 of the anodic film 11 are contacted by a maskless technique with a solution 20 containing a dissolved salt of a noble metal, e.g. platinum, palladium, gold etc., with the preferred noble metal being palladium, in concentrations ranging from 0.05 to 100 g/l, preferably 0.2 to 10 g/l. The original deposits 18 in the pores contacted by the solution 20 act as seeds for deposition of the noble metal and are at least partially replaced by the noble metal in the solution. Consequently, as shown in FIG. 1(E) by the differences in shading, deposits 21 in the treated areas differ from the deposits 18 in the untreated areas. These differences lead to differences in light absorption which in turn lead to difference in the observed colours of the treated and untreated areas. At present, the greatest colour contrast has been obtained when using silver for deposits 18 and Pd salts in the noble metal contacting solution. Colour changes from yellow to violet can then be produced when the noble metal solution is applied.

Since very little of the solution 20 is required, and since there is no requirement to contact the solution with electrodes or the like, the solution 20 can be applied without the need for prior application of an adhering mask to the surface 15, although a non-adhering mask, such as a stencil or silk screen, could be used to limit the areas of contact between the surface 15 and the solution 20 applied, for example, by spraying, brushing or wiping. Even such a non-adhering mask may not be required, however, if the solution is applied by a technique which restricts the area of application, e.g. flexographic printing, rubber stamping, painting, flowing, wiping, coarse spraying (to form separated droplets on the surface 15) or pulsed spraying. The solution 20 is usually applied in such small quantities that drying takes place very rapidly so smearing of the pattern can be avoided. Moreover, when the solution contains a low concentration of the noble metal, most of the noble metal is rapidly precipitated onto the contacted deposits and exhausted from the solution, so subsequent rinsing (e.g. with deionized water) does not smear the pattern.

The article bearing the resulting pattern of contrasting colours can be used if desired without further treatment steps and the colours thus obtained include dark brown on bronze, grey on brown, brown on grey or yellow, etc. However, the normal pore-sealing steps usually carried out after anodizing treatments, e.g. immersion in near-boiling water at or about neutral pH, can be employed and/or the surface 15 may be covered by a protective transparent film (not shown) attached by means of an adhesive or by heat sealing. Such a film would normally be a polymer sheet made, for example, of polyester.

The noble metal deposits 21 are stable and thus do not undergo fading or loss of colour uniformity. The remaining deposits 18 are as permanent as the deposits in conventional ANOLOK treatments and thus leaching may take place during subsequent processing steps. The deposits 18 can be made more resistant to leaching by a final rinse with a chromate solution prior to any pore sealing or laminating step.

If desired, additional visual effects can be imparted to the patterned articles produced by the basic procedure described above by carrying out a pretreatment of the surface of the metal article 10. For example, caustic etching may be employed to impart a satin finish, mechanical or chemical polishing may be used to create a bright finish, or sandblasting can be carried out for a dull finish, etc.

Although the steps shown in FIG. 1, referred to as a preferred basic process, are capable in themselves of producing an attractively patterned article, further steps and processes can be carried out, if desired, in order to create additional colours, appearances and colour combinations.

For example, structures having coloured areas on a colourless or white background can be produced by removing the non-noble deposits 18 from the pores 14 prior to any pore sealing, dichromate treatment or lamination of the structure of FIG. 1(E). The deposits 18 can be removed, for example, by exposing the porous film to an oxidizing and/or an acidic solution which leaches out the deposits 18 while leaving the noble metal deposits 21 substantially unaffected. Such a leaching step is not difficult because the deposits 18 are not usually very voluminous in view of the fact that light interference effects are relied on extensively for the colour generation. Moreover, if this step is intended, the metal selected for the deposits is preferably one having low resistance to leaching, e.g. cobalt.

Acidic aqueous solutions can be used for the leaching step and the structure can either be immersed in the solution or the solution can be sprayed onto or poured over the film 11. A 5% nitric acid solution requires only 1 to 5 minutes to leach out the non-noble deposits. Other acids, oxidants, etc. can be used provided the anodic oxide film is not thereby damaged beyond usefulness.

Figure 2:
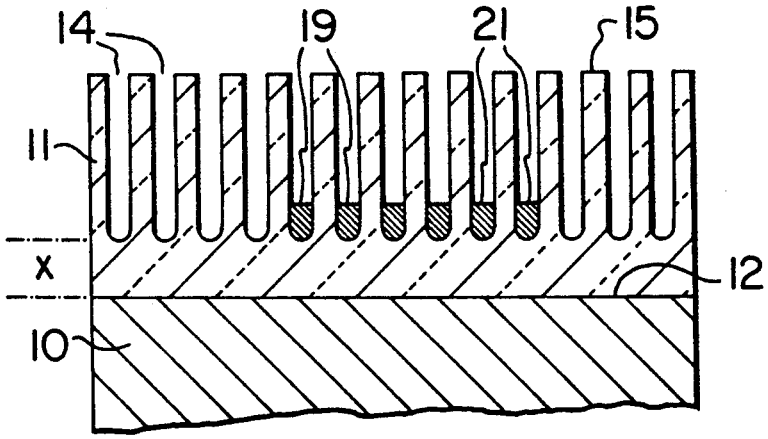
FIG. 2 is a cross-section similar to those in FIG. 1 after a first optional additional step.

The resulting film is as shown in FIG. 2, in which the areas of the film 11 having empty pores 14 are colourless and the limited areas having the deposits 21 appear coloured. The colours which can be generated in the limited areas are basically as described in our prior U.S. Pat. No. 4,068,816 (particulalarly Examples 4 and 5).

It is also possible to produce structures having a further range of colours against a colourless background by carrying out a further anodization step on the structure of FIG. 1(E) prior to any sealing, laminating or dichromate treatment. Such a step is similar to the process disclosed in our prior U.S. Pat. No. 4,310,586 to Sheasby et. al. (the disclosure of which is incorporated herein by reference). The electrolyte used for the further anodization step, which may be one of those mentioned above for the initial anodization step, at least partially leaches the non-noble metal deposits 18 out of the pores 14 while leaving the noble metal deposits 21 unaffected so the overall result is similar to the simple treatment mentioned above. However, the additional anodization step thickens the film 11 and increases the separation of the remaining deposits 21 from the underlying metal surface 12. This changes the interference effects generated by reflections from the semi-refective surface formed by the deposits 21 and the surface 12. The voltage employed for the additional anodization must be sufficient to overcome the electrical resistance imposed by the existing barrier layer 17 and metal deposits 18, 21. In general, the voltage should be equal to or greater than the final voltage used for the formation of the structure of FIG. 1(B).

Figure 3:
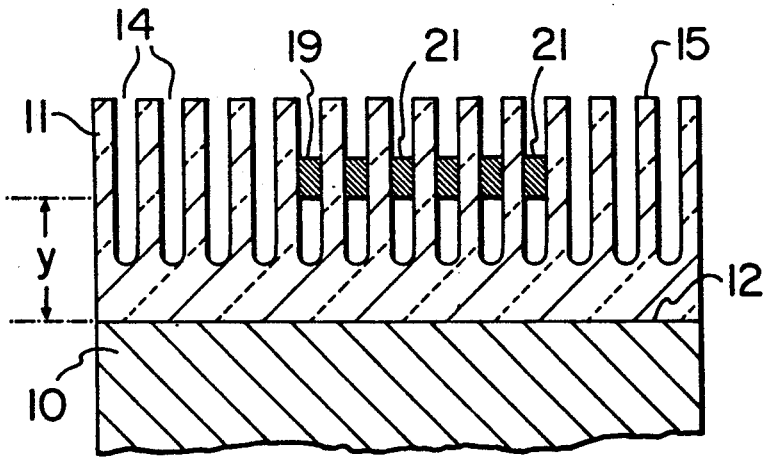
FIG. 3 is a cross-section similar to those in FIG. 1 after a second optional additional step.

The resulting film has the structure shown in FIG. 3. The increase in film thickness below the deposits 21 (compare distances "x" and "y" in FIGS. 2 and 3, respectively) results in the generation of additional interference colours for the reason mentioned above. For such interference colours to be produced, the additional layer of film 11 grown beneath the deposits 21 should be kept below 1 micron, preferably 0.05–0.75 microns. The colours which can be obtained in this way are clear blues, reds, greens, purples, oranges, etc. free of "muddiness" or bronze colours often associated with electrodeposited metals.

Further processes can be carried out, if desired, in order to produce structures having coloured areas on a coloured background. While this is true of the structure of FIG. 1(*e*), the structure can be modified to increase the range of colours of both the patterned and background areas. This can be achieved in several ways, as indicated in the following.

First of all, the non-noble metal deposits 18 may be only partially leached from the pores 14 during a subsequent leaching step or a subsequent anodization step of the type mentioned above. Partial leaching of the deposits 18 can be achieved either by using a non-noble metal which is moderately resistant to leaching, e.g. Sn-Ni and Cu-Ni alloys, or by using an acid in the leaching solution or electrolyte that is less aggressive than the acids used for complete removal of the deposits. The resulting structures often exhibit a coloured pattern on a background of the same, but less saturated, colour. The structures are similar to those of FIGS. 2 and 3, but the empty pores 14 shown in these figures contain deposits of reduced volume.

In a further modification of the process, the structure of FIG. 1(E) may be made to undergo further anodization, as in the process leading to the structure of FIG. 3, but the further anodization may be interrupted prior to complete removal of the non-noble metal deposits 18 from the pores 14 and the entire film 11 may then be contacted with a solution of a noble metal salt in order to replace (at least partially) the partially leached deposits 18 with a noble metal. The further anodization step may then be continued without further loss of the partially leached deposits, thus maintaining the colour saturation of the background while enabling additional colours to be generated in the patterned and background areas by the production of a thickened film 11. This has the advantage of enabling a greater range of colours to be produced both in the patterned and background areas without employing a highly acid resistant metal to form the initial deposits 18.

Finally, a structure having a pattern of one colour on a background of the same colour of different saturation can be produced merely by contacting the entire surface of the structure of FIG. 1(E) with a dilute solution of a noble metal salt. This at least partially converts the remaining deposits 18 to noble metal, thus making them resistant to leaching, while maintaining a difference in colour saturation between the patterned areas and the background.

The procedures described above have all been concerned with the production of a patterned anodized surface on an article (substrate) made of or coated with aluminum or an aluminum alloy. The process of the invention can, however, be used to form a patterned anodic film structure detached from the aluminum-containing article on which it was formed. The present invention includes the formation of such detached patterned films which can be produced in the manner indicated below.

Any one of the structures referred to above, e.g. the structures of FIG. 1(E), FIG. 2, FIG. 3 or the partially leached structures, may be made to undergo a final anodization step, either as part of the last anodization step of the formation process or as a separate final step, that involves a voltage reduction procedure which introduces a weakened stratum into the structure at the metal/oxide interface 12. Voltage reduction procedures of this kind are disclosed in our European patent application no. 0,178,831 published on Apr. 23, 1986 (the disclosure of which is incorporated herein by reference). The starting voltage should be higher than or equal to the highest anodizing voltage used previously and the voltage is then reduced either continuously or step-wise until it approximates zero. The film is allowed periods of soaking in the acidic electrolyte between the voltage reduction steps or as the reduction proceeds. This results in a pore branching phenomenon at the inner ends of the pores 14 as shown, for example, in FIG. 4 (which shows the result of the voltage reduction procedure carried out on the structure of FIG. 3). The pores 14 divide into numerous narrow channels 14A adjacent to the underlying metal surface 12 which reduces the thickness of the barrier layer 17 (FIG. 1(B)) and makes the film 11 very easy to detach from the metal article 10.

Figure 4:
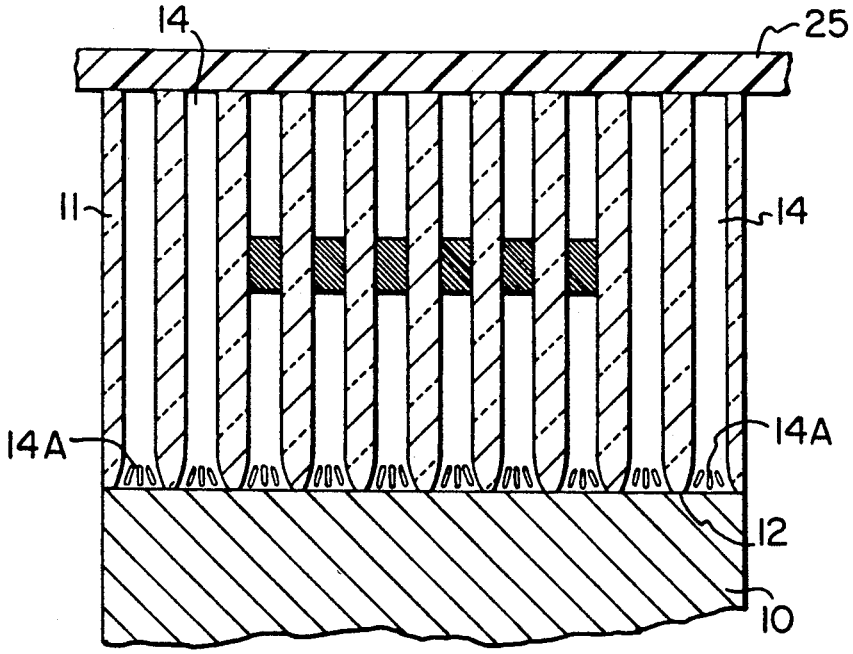
FIG. 4 is a cross-section similar to FIG. 3 following a final voltage reduction step during anodization to make the anodic film detachable from the metal article.
Figure 5:
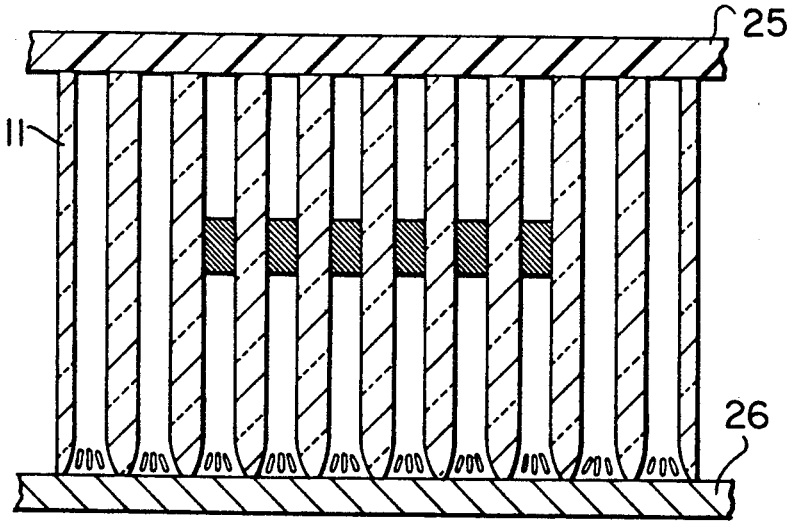
FIG. 5. shows the film of FIG. 4 detached from the metal article and provided with a thin layer of reflective metal.

As shown in FIG. 4, a flexible transparent overlayer 25 is then attached to the anodic film, e.g. a polymer film (such as polyester) applied by heat sealing or by means of an adhesive, and the flexible overlayer 25 is then used to detach the film 11 from the metal article 10 by pulling or peeling. As shown in FIG. 5, once the film has been detached from the article 10, a reflective metal layer 26 is applied, e.g. sputtering or other vacuum deposition technique, to the exposed film surface in order to provide the necessary reflections for colour generation. The metal used for the layer 26 need not be an aluminum-containing metal and need only be a fraction of a micron in thickness, but could be thicker if desired for greater durability. The resulting structure comprises a detached anodic film 11 sandwiched between a flexible transparent layer 25 and a thin flexible metal layer 26. Since the colour generating surfaces remain in place, the film 11 appears to have a coloured pattern against a coloured or colourless background when viewed through the transparent film 25. Such structures can be used, for example, as patterned packaging films.

Figure 6:
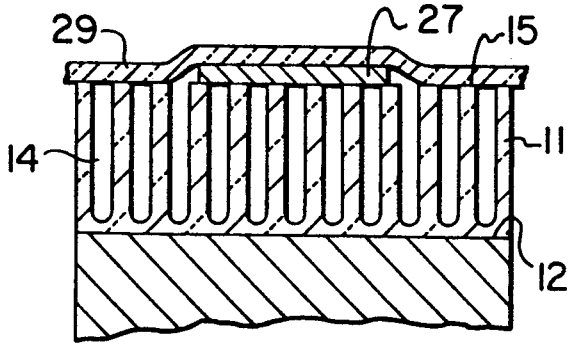
FIG. 6 is a cross-section of a patterned structure formed by the process of the invention, in which the metal is deposited on top of the anodic film rather than in the pores of the film.

As a final point, it should be noted that, if the film 11 is made suitably thin in a structure as shown in FIG. 1 (B), a discontinuous (semi-reflective) metal layer may be applied to the outer surface 15 of the film 11 rather than being deposited by electrodeposition within the pores 14. A layer of this kind can be formed, for example, by sputtering or other vacuum deposition techniques. Patterned areas of the metal layer may then be treated with the noble metal solution and then further steps carried out as before. A typical structure produced in this way by steps similar to those resulting in the structure of FIG. 2 is shown in FIG. 6. In this case, the separation between the semi-refective layer 27 and the underlying metal surface 12 is sufficiently small (e.g. less than 1 micron), that interference takes place between light reflected from these surfaces. The metal layer 27, being exposed and very thin, should preferably be protected by a layer 29 of transparent material, such as a lacquer or polymer film.

Since the film 11 is necessarily very thin in this form of the invention, an anodization procedure which results in a non-porous barrier film rather than a porous film may be employed. As was mentioned earlier, non-porous films of this type can be produced by anodization in non-acid or weakly acidic electrolytes and the thickness of the barrier films is determined by the voltage used for the anodization step. Film thickness in the range of 0.05 to 0.25 microns can be produced in this way.

Depending on film thicknesses and the like, the patterns produced by the present invention are sometimes dichroic or optically variable (i.e. they exhibit different colours at different viewing angles). This is very useful for certain applications, e.g. security applications, because such effects cannot be reproduced by colour photocopiers and the like.

The present invention is illustrated in more detail by the following non-limiting Examples.

EXAMPLE 1

This Example produced a well defined optically variable coloured pattern on a non-coloured background.

An aluminum foil/polyester laminate was anodized in 15. M $H_2SO_4$ at 21° C. at 10 V DC for a period of 3 minutes. It was then rinsed and re-anodized in 1 M $H_3PO_4$ at 21° C. at 10 V DC for 2 additional minutes. After rinsing well, nickel was electrolytically deposited into the porous oxide from a standard nickel ANOLOK solution (25 g/l nickel sulphate heptahydrate, 20 g/l magnesium sulphate heptahydrate, 25 g/l boric acid, 15 g/l ammonium sulphate) using a 30 second treatment at 9 V AC peak, 60 Hz. After rinsing and air drying a solution containing 10 g/l $PdCl_2$ was roll printed using flexography on to the surface in a defined pattern. After drying, the laminate was re-introduced into the sulphuric acid solution and anodized for 130 seconds at 12.5 V DC. The laminate was then rinsed and sealed.

The resulting green pattern appeared violet when viewed at an angle of 45°.

EXAMPLE 2

This Example produced a well defined blue pattern on a non-coloured background (no preliminary anodizing step).

An aluminum foil/polyester laminate was anodized in 1 M $H_3PO_4$ at 21° C. at 10 V DC for 1¼ minutes. After rinsing well, nickel was electrolytically deposited into the porous oxide from a standard nickel ANOLOK solution (see Example 1) using a 30 second treatment at 9 V AC peak, 60 Hz. After rinsing and air drying, a solution containing 2 g/l $PdCl_2$ was roll printed using flexography on to the surface in a defined pattern. After drying the laminate was anodized in 1.5 M 21° C. sulphuric acid using 12.5 V DC for 90 seconds. The laminate was then rinsed and sealed.

EXAMPLE 3

This Example produced a well defined purple pattern on a non-coloured background (single acid and no preliminary anodizing).

An aluminum foil/polyester laminate was anodized in 1 M $H_3PO_4$ at 21° C. at 10 V DC for 1¼ minutes. After rinsing well, nickel was electrolytically deposited into the porous oxide from a standard nickel ANOLOK solution (see Example 1) using a 30 second treatment at 9 V AC peak, 60 Hz. After rinsing and air drying, a solution containing 2 g/l $PdCl_2$ was roll printed using flexography on to the surface in a defined pattern. After drying, the laminate was anodized in the original acid using 12.5 V DC for 8 minutes. The laminate was then rinsed and sealed.

EXAMPLE 4

This Example produced a well defined optically variable pattern on a coloured background.

An aluminum foil/polyester laminate was anodized in 1 M $H_3PO_4$ at 21° C. at 15 V DC for 2 minutes. After rinsing well, nickel was electrolytically deposited into the porous oxide from a standard nickel ANOLOK solution (see Example 1) using a 20 second treatment at 12 V AC peak, 60 Hz. After rinsing and air drying, a solution containing 0.5 g/l AuCl was roll printed using flexography on to the surface in a defined pattern. After drying, the laminate was anodized in 1.5 M 21° C. sulphuric acid using 15 V DC for 110 seconds. This period of anodizing was interrupted at the 10 second mark, at which time the laminate was removed and then immersed in a 300 ppm $PdSO_4$ solution for 1 minute. After anodizing the laminate was rinsed and sealed.

The resulting pink pattern changed to yellow when viewed at an angle of 45°. The background colour was also pink but it was less saturated than the pattern.

EXAMPLE 5

This Example produced a random bronze dot/streak pattern on clear architectural class 10 aluminum extrusion.

Alloy 6063 extrusion of the type used for framing pictures etched and anodized in 1.5 M $H_2SO_4$ at 21° C. at 16 V DC for a period of 30 minutes to produce a 10 micron anodic film. It wa then rinsed and reanodized in 1 M $H_3PO_4$ at 21° C. at 15 V DC for 3 additional minutes. After rinsing well, nickel was electrolytically deposited into the porous oxide from a standard nickel ANOLOK solution (see Example 1) using a 25 second treatment at 12 V AC peak, 60 Hz. After rinsing and air drying, small droplets of solution containing 5 g/l $PdCl_2$ were splashed onto the medium bronze surface. The extrusion was then allowed to soak in an acid (pH 2) rinse water for 20 minutes, during which time all the non-contacted metal deposits leached from the film. The extrusion was then sealed in boiling water.

EXAMPLE 6

This Example produced a defined, highly saturated blue/grey pattern on clear architectural class 10 aluminum extrusion.

Alloy 6063 extrusion of the type used for framing pictures was caustic etched and anodized in 1.5 M $H_2SO_4$ at 21° C. at 16 V DC for a period of 30 minutes to produce a 10 micron anodic film. It was then rinsed and reanodized in 1 M $H_3PO_4$ at 21° C. at 15 V DC for 3 additional minutes. After rinsing well, nickel was electrolytically deposited into the porous oxide from a standard nickel ANOLOK solution (see Example 1) using a 75 second treatment at 12 V AC peak, 60 Hz. After rinsing and air drying, a solution containing 0.5 g/l AuCl was roll printed on to the blue/grey surface using flexography in a defined pattern. The extrusion was then allowed to soak in 5% V/V $HNO_3$ for 4 minutes, during which time all the non-contacted metal deposits leached from the film. The extrusion was then sealed in boiling water.

EXAMPLE 7

This Example produced a brushed-on coloured pattern (purple) on clear architectural class 10 aluminum extrusion.

Alloy 6063 extrusion of the type used for framing pictures was caustic etched and anodized in 1.5 M $H_2SO_4$ at 21° C. at 16 V DC for a period of 60 minutes to produce a 20 micron anodic film. It was then rinsed and reanodized in 1 M $H_3PO_4$ at 21° C. at 1O V AC for 3 minutes followed by 1O V DC for 1 minute. After rinsing well, nickel was electrolytically deposited into the porous oxide from a standard nickel ANOLOK solution (see Example 1) using a 25 second treatment at 9 V AC peak, 60 Hz. After rinsing and air drying, a solution containing 0.5 g/l $PdCl_2$ was brushed on to the surface in well defined areas. After air drying, the work piece was anodized in the original sulphuric acid solution at 10 V DC for a period of 120 seconds. It was then rinsed and sealed in boiling water.

EXAMPLE 8

This Example produced a brushed-on dual tone bronze pattern on coloured architectural class 20 aluminum extrusion.

Alloy 6063 extrusion of the type used for framing pictures was caustic etched and anodized in 1.5 M $H_2SO_4$ at 21° C. at 16 V DC for a period of 60 minutes to produce a 20 micron anodic film. It was then rinsed and reanodized in 1 M $H_3PO_4$ at 21° C. at 1O V AC for 3 minutes, followed by 1O V DC for 1 minute. After rinsing well, nickel was eleotrolytically deposited into the porous oxide from a standard nickel ANOLOK solution (see Example 1) using a 25 second treatment at 9 V AC peak, 60 Hz. After rinsing and air drying, a solution containing 0.5 g/l $PdCl_2$ was brushed on to the surface in well defined areas. It was then rinsed and sealed in boiling water.

EXAMPLE 9

This Example produced a well defined optically variable pattern that had been transferred from the aluminum host to a transparent polymer material.

AA5657 aluminum sheet was cleaned then anodized in 1.5 M $H_2SO_4$ at 21° C. at 1O V DC for a period of 1 minute. It was then rinsed and re-anodized in 1 M $H_3PO_4$ at 30° C. at 10 V AC for 1.5 minutes. After rinsing well, nickel was electrolytically deposited into the porous oxide from a standard nickel ANOLOK solution (see Example 1) using a 25 second treatment at 9 V AC peak, 60 Hz. After rinsing and air drying, a solution containing 0.5 g/l $PdCl_2$ was flexographically printed onto the surface in a well defined pattern. After air drying, the panel was then anodized in the sulphuric acid bath for 140 seconds at 12.5 V DC and subsequently transferred back to the phosphoric bath, during which time a peelable membrane was created by anodizing at 12.5 V DC for 10 seconds and then reducing the voltage in stepwise fashion until, after 2.5 minutes, the applied voltage was zero. The panel was allowed to soak for an additional 1.5 minutes before it was removed, rinsed and dried. A transparent polymer was then heat sealed to the surface and the panel was subsequently peeled away leaving the porous oxide containing a patterned deposit on the polymer. The interference colour in the patterned areas was regenerated by vacuum depositing a thin metal film on to the surface of the membrane.

The patterned plastic film was green, changing to violet when viewed at a 45° angle.

EXAMPLE 10

This Example produced a well defined optically variable pattern on a coloured background.

An aluminum foil/polyester laminate was anodized in 1 M $H_3PO_4$ at 21° C. at 15 V DC for two minutes. After rinsing well, nickel was electrolytically deposited into the porous oxide from a standard nickel ANOLOK solution (see Example 1) using a 20 second treatment at 12 V AC peak, 60 Hz. After rinsing and air drying, a solution containing 0.5 g/l $PtCl_2$ was roll printed using flexography onto the surface in a defined pattern. At this time, the laminate was immersed in 100 ppm $PdSO_4$ for 1 minute. The laminate was then anodized in 1.5 M, 21° C. $H_2SO_4$ using 15 V DC for 120 seconds. After anodizing, the laminate was rinsed and sealed.

The resulting pink pattern changed to yellow when viewed at an angle of 45° C. The background colour was also pink, but it was less saturated than the patterned area.

What I claim is:

1. A process for producing a structure incorporating an anodic film exhibiting a coloured pattern, which process comprises:

anodizing a surface of a substrate made of or coated with an anodizable metal selected from the group consisting of aluminum and anodizable aluminum alloys, to produce an anodic film formed on an underlying metal surface;

depositing a semi-refective layer of a non-noble metal on or within said film such that reflections from said semi-refective layer contribute to the generation of a visible colour by effects including light interference; and contacting limited areas of said film with a solution of a noble metal compound by a maskless technique in order to at least partially replace said non-noble metal in said limited areas with said noble metal while leaving said non-noble metal in other areas of said film unaffected.

2. A process according to claim 1 wherein said anodizing step is carried out in conditions which make said anodic film porous.

3. A process according to claim 2 wherein said semi-refective layer is deposited within said film by electrodeposition of deposits of said non-noble metal within pores in said film.

4. A process according to claim 1 wherein said maskless procedure is selected from the group consisting of flexographic printing, rubber stamping, spraying coarse droplets, pulsed spraying, application by pen, paint brush or sponge, spraying through a stencil and silk screening.

5. A process according to claim 3 wherein said non-noble metal deposits are deposited in said pores to a height which results in interference between outer surfaces of said deposits and said underlying metal surface.

6. A process according to claim 1 which further comprises contacting said film with a solution capable of leaching away said semi-refective metal layer of said non-noble metal from said other areas of said film.

7. A process according to claim 1 which further comprises anodizing said structure following said contact of said solution of said noble metal compound with said limited areas of said film in an electrolyte capable of leaching said semi-refective layer of non-noble metal from said other areas of said film in order to increase a thickness of said film between said noble metal and said underlying metal surface and to remove said non-noble metal from said other areas of said film.

8. A process according to claim 1 which further comprises partially leaching said non-noble metal from said other areas of said film by contacting said film with a solution capable of partially leaching said non-noble metal.

9. A process according to claim 1 which further comprises anodizing said structure following said contact of said solution of said noble metal compound with said limited areas of said film in an electrolyte capable of partially leaching said semi-refective layer of non-noble metal from said other areas of said film in order to increase a thickness of said film between said noble metal and said underlying metal surface and to partially remove said non-noble metal from said other areas of said film.

10. A process according to claim 1 which further comprises contacting said film with a dilute solution of a noble metal compound.

11. A process according to claim 1 which further comprises contacting said film with a chromate solution in order to make said non-noble metal more resistant to acid leaching.

12. A process according to claim 2 which further comprises subjecting said film to a pore sealing step.

13. A process according to claim 1 wherein said non-noble metal is selected from the group consisting of nickel, cobalt, copper, silver, tin, cadmium, iron, lead, manganese, molybdenum and alloys thereof.

14. A process according to claim 1 wherein said non-noble metal is selected from the group consisting of nickel, cobalt, tin and alloys thereof.

15. A process according to claim 1 wherein said noble metal is selected from the group consisting of palladium, gold and platinum.

16. A process according to claim 1 wherein said noble metal is palladium.

* * * * *

UNITED STATES PATENT AND TRADEMARK OFFICE

CERTIFICATE OF CORRECTION

PATENT NO. : 5,167,793

DATED : December 1, 1992

INVENTOR(S) : Mark A. Jozefowicz

It is certified that error appears in the above-indentified patent and that said Letters Patent is hereby corrected as shown below:

Abstract, line 8, change "semi-refective" to --semi-reflective--. Column 2, lines 8, 44, 46, 57-58, 59 and 67-68, change "semi-refective" (each occurrence) to --semi-reflective--. Column 3, lines 1-2, change "semi-refective" to --semi-reflective--; line 32, change "snow" to --show--. Column 5, line 1, change "semi-refective" to --semi-reflective--. Column 7, line 4, change "semi-refective" to --semi-reflective--. Column 9, line 6, change "semi-refective" to --semi-reflective--. Column 12, lines 43, 45 and 57-58, change "semi-refective" (each occurrence) to --semi-reflective--. Column 13, lines 5, 11 and 25, change "semi-refective" (each occurrence) to --semi-reflective--.

Signed and Sealed this

Twenty-second Day of March, 1994

Bruce Lehman

*Attest:*

BRUCE LEHMAN

*Attesting Officer*

*Commissioner of Patents and Trademarks*